US005480120A

United States Patent [19]

Bruner

[11] Patent Number: 5,480,120

[45] Date of Patent: Jan. 2, 1996

[54] ADJUSTABLE HANGER APPARATUS

[76] Inventor: Bobby R. Bruner, 6330 Laurel La., Placerville, Calif. 92667

[21] Appl. No.: 228,365

[22] Filed: Apr. 15, 1994

[51] Int. Cl.[6] ..... A47G 1/24

[52] U.S. Cl. ..... 248/477; 248/496

[58] Field of Search ..... 248/477, 496, 248/497, 476, 489, 495, 475.1, 547; 40/152.1

[56] References Cited

U.S. PATENT DOCUMENTS

| | | | |
|---|---|---|---|
| 2,478,256 | 8/1949 | Eysmann | 248/496 |
| 2,757,890 | 8/1956 | Sutton et al. | 248/496 X |
| 2,877,972 | 3/1959 | Sutton et al. | 248/496 |
| 2,898,064 | 8/1959 | Scott | 248/496 |
| 3,063,666 | 11/1962 | Morrison | 248/496 |
| 3,360,229 | 12/1967 | Beyer | 248/496 |
| 4,083,525 | 4/1978 | Rath | 248/477 X |
| 4,515,338 | 5/1985 | Schneider | 248/496 X |
| 4,712,761 | 12/1987 | Wassell | 248/489 X |
| 4,871,140 | 10/1989 | Hoskinson et al. | 248/477 X |

*Primary Examiner*—David M. Purol

[57] ABSTRACT

An adjustable hanger apparatus is provided for hanging an object on a vertical surface and includes a first hanger assembly for mounting on the vertical surface and a second hanger assembly for mounting on the object. The first hanger assembly includes a first connector portion. The second hanger assembly includes a longitudinal axis and includes a plurality of second connection portions arrayed along the longitudinal axis. The second connection portions are adapted to connect to the first connector portion of the first hanger assembly, such that, when a selected second connection portion is connected to the first connector portion, the object hangs by the second hanger assembly and the first hanger assembly next to the vertical surface. Adjustment of vertical position of the object on the vertical surface is obtained by selecting a specific second connection portion along the longitudinal axis. The first hanger assembly has a first width; the second hanger assembly has a second width; and the first width is greater than the second width. With the first width being greater than the second width, the second hanger assembly can be moved horizontally with respect to the first hanger assembly, whereby the object attached to the second hanger assembly can be positioned horizontally along the first hanger assembly that is connected to the vertical surface.

12 Claims, 4 Drawing Sheets

ADJUSTABLE HANGER APPARATUS

BACKGROUND OF THE INVENTION

1. Field of the Invention

The present invention relates generally to hanger devices and, more particularly, to devices especially adapted for hanging pictures and the like on vertical surfaces such as walls.

2. Description of the Prior Art

It is common practice in homes and offices to hang pictures and the like on vertical surfaces such as walls. Commonly, a portion of a nail or screw is driven into a wall at an acute angle leaving another portion of the nail or screw projecting from the wall. A picture frame, that has a cord or wire attached, is hung by the cord or wire on the portion of the nail or screw that projects from the wail. This simple approach to hanging picture on a wall has a number of disadvantages.

When a picture is hung on a wall, it is often desired that the picture be located at a precise location on the wall. However, because a cord or wire is flexible it is often difficult to know exactly where to drive the supporting nail or screw into the wall so that the picture, when hanging from the cord or wire, will be positioned on the wall at the precise location on the wall that is desired. In this respect, it would be desirable if a picture hanging device were provided which does not employ a flexible cord or wire for hanging the picture on a wall.

After a supporting nail or screw is driven into a wall and after the picture is hung by a flexible cord or wire from the supporting nail or screw, it may be observed that the actual location of the picture on the wall is either higher than or lower than the desired location on the wall. As a result, the supporting nail or screw must be removed from the wall leaving a hole, and the nail or screw must be driven into a location that is either higher or lower than the initial position. The picture may be rehung from the supporting nail or screw at the second position on the wall and may still be at an undesirable location on the wall. This process of trial and error may result in a number of undesirable holes arrayed vertically in a wall. In this respect, it would be desirable if a picture hanging device were provided which did not require a process of trial and error potentially resulting in a number of improperly vertically located holes in a wall.

When a picture is hung on a wall, its vertical positioning is not the only important positioning criteria. For proper picture positioning, the picture must be properly located horizontally as well. When a wall-supported nail or screw and a picture that employs a cord or wire are employed, it may be difficult to properly locate the picture horizontally on the wall without resorting to a number of horizontally arrayed unwanted holes necessitated by trial and error. In this respect, it would be desirable if a picture hanging device were provided which does not require a process of trial and error potentially resulting in a number of improperly horizontally located holes in a wall.

Throughout the years, a number of innovations have been developed relating to objects, including pictures, from vertical surfaces, and the following U.S. patents are representative of some of those innovations: U.S. Pat. Nos. 1,172,937; 2,317,368; 4,407,478; 4,557,455; 4,568,055; and 4,728,237. More specifically, U.S. Pat. No. 1,172,937 discloses article hangers that are suspended from a flexible strap or chain. The disadvantages of a flexible cord or wire for suspending a picture have been discussed hereinabove.

U.S. Pat. No. 2,317,368 discloses a picture hook which is employed with a flexible cord or wire for suspending a picture.

U.S. Pat. No. 4,407,478 discloses a J-shaped pipe hanger that receives a pipe with a snap fit. In order for a snap fit to be implemented, either the pipe or the hanger must be sufficiently flexible to permit a snap connection between the two. Requiring such a snap fit places burdensome restrictions of the types of materials that can be employed in fabricating the pipe and the pipe holder. In this respect, it would be desirable if a picture hanging device were provided which does not require a snap fit and which, therefore, is not severely restricted in the kinds of materials that can be employed in fabricating the hanger apparatus.

U.S. Pat. No. 4,557,455 discloses a hanging apparatus which includes a flexible tongue to lock against a serrated strip. This device permits vertical adjustment, but it does not provide for horizontal adjustment.

U.S. Pat. No. 4,568,055 discloses serrated corner braces attached to respective corners of a picture frame. These corner braces can be supported by respective support nails or screws driven into a wall. Yet, the corner braces do not permit vertical or horizontal repositioning of the location of the picture on the wall unless the respective locations of the support nails or screws are changed vertically or horizontally. In this respect, it would be desirable if a picture hanging device were provided which does not require readjusting support nails or screws vertically or horizontally in order to readjust the vertical and horizontal position of a picture supported by the support nails or screws.

U.S. Pat. No. 4,728,237 discloses a picture frame hanger that is driven into a picture frame. The hanger has an aperture that fits around a support nail. This hanger does not permit vertical or horizontal adjustment of the picture frame on the wall without relocation of a support nail.

U.S. Pat. No. 4,343,450 may be of interest for its disclosure of a plate holder whose intended purpose is to hold a plate at a desired tilt angle on a horizontal surface.

Thus, while the foregoing body of prior art indicates it to be well known to use wall-mounted nails to hang pictures on a wall, the prior art described above does not teach or suggest an adjustable hanger apparatus which has the following combination of desirable features: (1) does not employ a flexible cord or wire for hanging a picture on a wall; (2) does not require a process of trial and error resulting in a number of improperly vertically located holes in a wall; (3) does not require a process of trial and error resulting in a number of improperly horizontally located holes in a wall; (4) is not severely restricted in the kinds of materials that can be employed in fabricating the hanger apparatus; and (5) does not require readjusting support nails vertically or horizontally in order to readjust the vertical and horizontal position of a picture supported by the support nails. The foregoing desired characteristics are provided by the unique adjustable hanger apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides an adjustable hanger apparatus for hanging an object on a vertical surface and includes a first hanger assembly for mounting on the vertical surface and a second hanger assembly for mounting on the object. The first hanger assembly includes a first connector portion. The second hanger assembly includes a longitudinal axis and includes a plurality of second connection portions arrayed along the longitudinal axis. The second connection portions are adapted to connect to the first connector portion of the first hanger assembly, such that, when a selected second connection portion is connected to the first connector portion, the object hangs by the second hanger assembly and the first hanger assembly next to the vertical surface.

The first hanger assembly has a first width; the second hanger assembly has a second width; and the first width is greater than the second width. The first hanger assembly may include a pair of fastener-receiving portions located at opposite ends of the first hanger assembly. A first connector portion is located between the fastener-receiving portions. Each of the fastener-receiving portions includes a rear wall and a channel for receiving a fastener. The rear wall and the channel are oriented with respect to each other at a first predetermined acute angle. The first predetermined acute angle is in a range spanning thirty to sixty degrees. The first predetermined acute angle may be approximately forty-five degrees.

The first connector portion may include a tongue that projects outward from the first hanger assembly. Each of the second connection portions of the second hanger assembly includes a ridge portion and a groove portion. The first hanger assembly may include a well portion located adjacent to the first connector portion. The well portion is adapted to receive the ridge portion of a selected second connection portion.

The well portion includes a first inner wall and a second inner wall which are oriented with respect to each other at a second predetermined acute angle. The ridge portion includes a front wall and a rear wall, and the front wall and the rear wall of the ridge portion are oriented with respect to each other at a third predetermined acute angle. The third predetermined acute angle is less than or equal to the second predetermined acute angle, whereby the ridge portion is capable of fitting into the well portion with a tight fit.

The first hanger assembly may include a double-nail assembly adapted to be driven in the vertical surface. The double-nail assembly includes a pair of nail portions, and a transverse bar portion is connected between the nail portions. The transverse bar portion serves as the first connector portion of the first hanger assembly for connecting to the second connection portion of the second hanger assembly.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved adjustable hanger apparatus which has all of the advantages of the prior art and none of the disadvantages.

It is another object of the present invention to provide a new and improved adjustable hanger apparatus which may be easily and efficiently manufactured and marketed.

It is a further object of the present invention to provide a new and improved adjustable hanger apparatus which is of durable and reliable construction.

An even further object of the present invention is to provide a new and improved adjustable hanger apparatus which is susceptible of a low cost of manufacture with regard to both materials and labor, and which accordingly is then susceptible of low prices of sale to the consuming public, thereby making such adjustable hanger apparatus available to the buying public.

Still yet a further object of the present invention is to provide a new and improved adjustable hanger apparatus which does not employ a flexible cord or wire for hanging a picture on a wall.

Still another object of the present invention is to provide a new and improved adjustable hanger apparatus that does not require a process of trial and error resulting in a number of improperly vertically located holes in a wall.

Yet another object of the present invention is to provide a new and improved adjustable hanger apparatus which does not require a process of trial and error resulting in a number of improperly horizontally located holes in a wall.

Even another object of the present invention is to provide a new and improved adjustable hanger apparatus that is not severely restricted in the kinds of materials that can be employed in fabricating the hanger apparatus.

Still a further object of the present invention is to provide a new and improved adjustable hanger apparatus which does not require readjusting support nails vertically or horizontally in order to readjust the vertical and horizontal position of a picture supported by the support nails.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
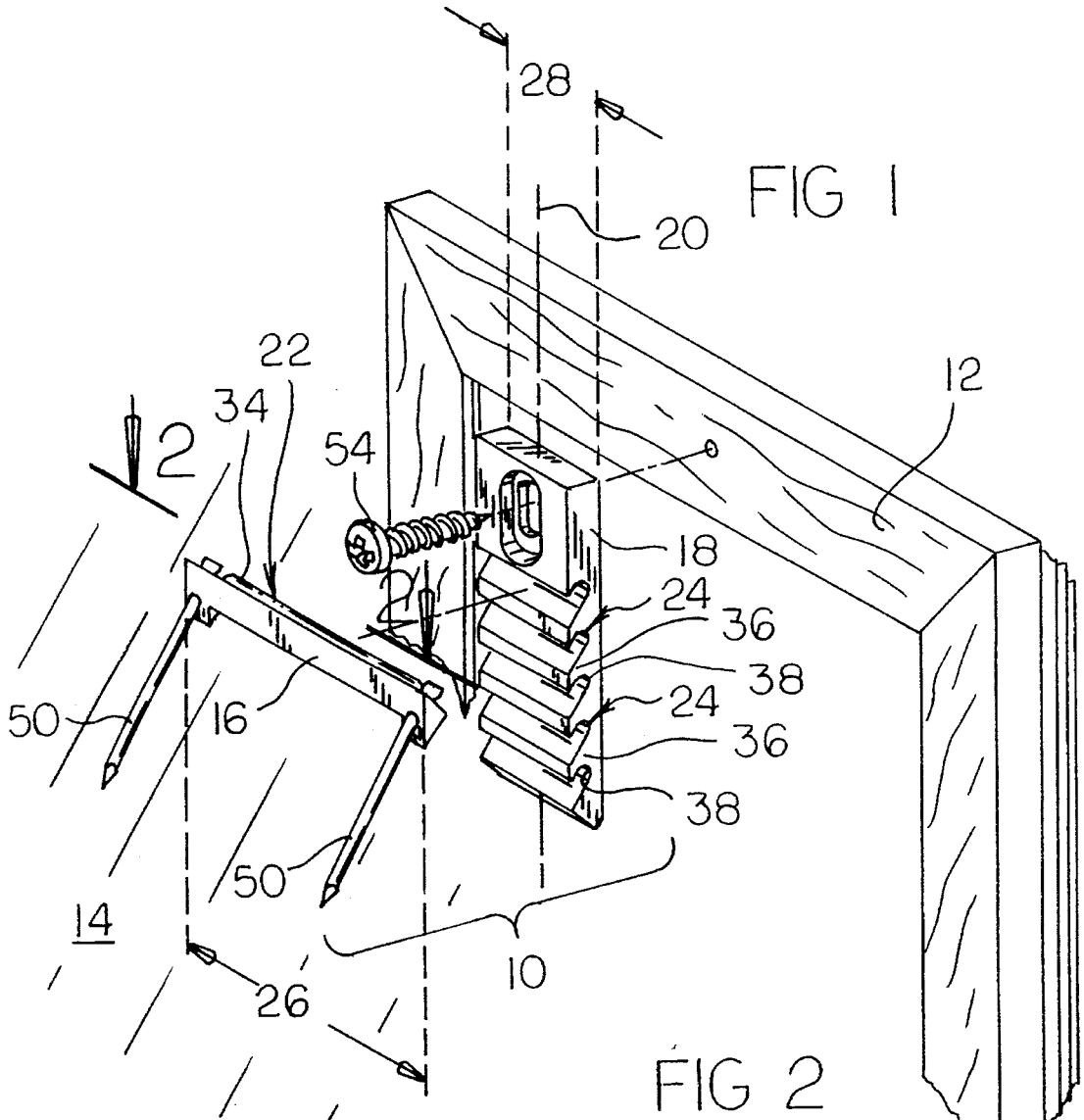
FIG. 1 is an exploded perspective view showing a preferred embodiment of the adjustable hanger apparatus of the invention for use in hanging a picture on a wall.
Figure 2:
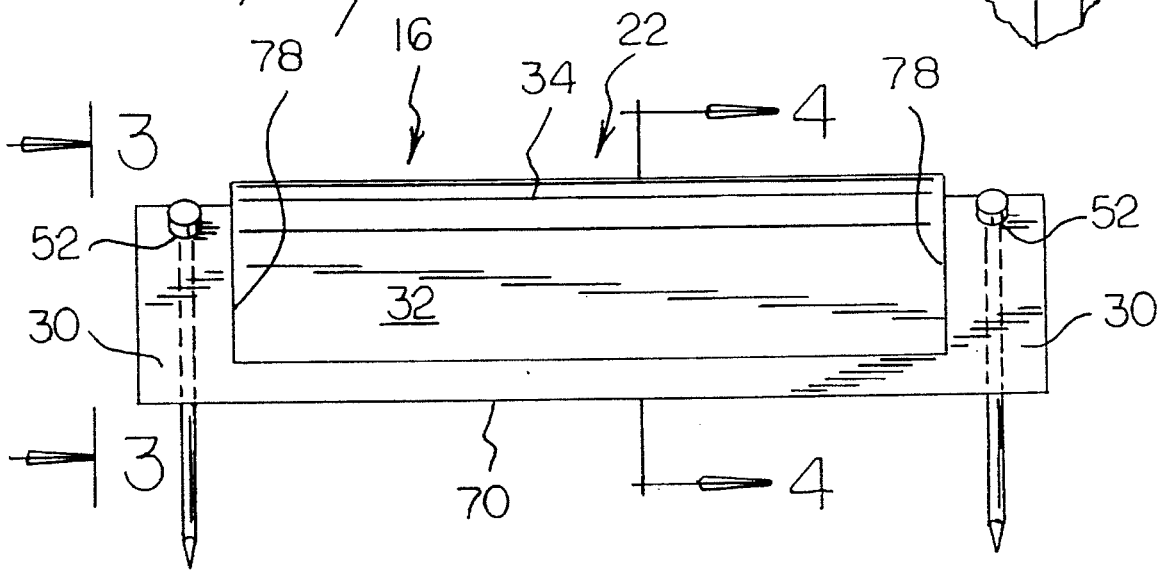
FIG. 2 is an enlarged top view, taken along line 2—2 in FIG. 1, of the wall-mounted portion of the embodiment of the invention shown in FIG. 1.
Figure 3:
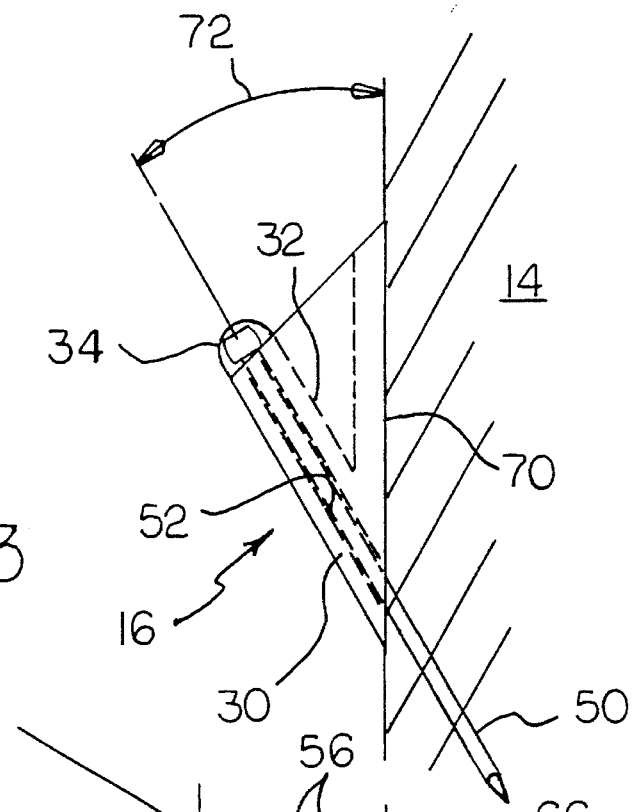
FIG. 3 is an enlarged side view of the wall-mounted portion of the invention shown in FIG. 2 taken along line 3—3 of FIG. 2.
Figure 4:
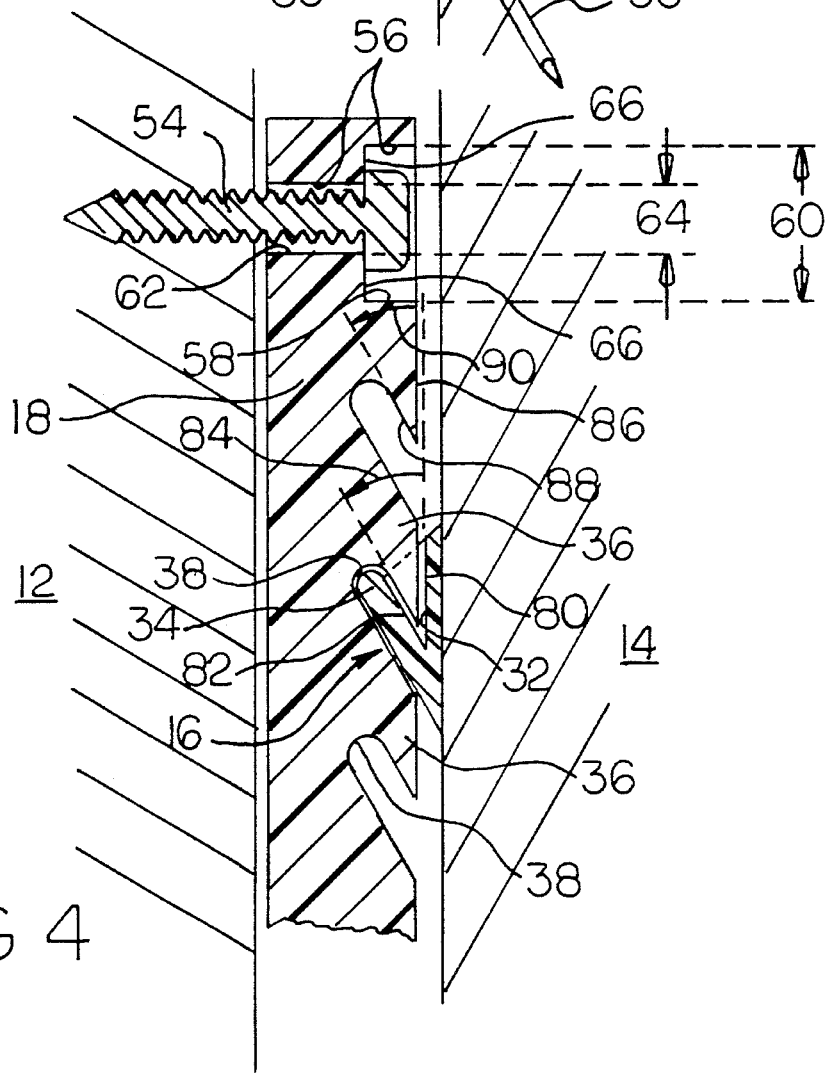
FIG. 4 is a cross,sectional view, taken along line 4—4 of FIG. 2, of the wall-mounted portion of the invention shown in FIG. 2 and also including a cross-sectional view of the picture-mounted portion of the invention shown in FIG. 1.

With reference to the drawings, a new and improved adjustable hanger apparatus embodying the principles and concepts of the present invention will be described.

Turning to FIGS. 1–4, there is shown a first exemplary embodiment of the adjustable hanger apparatus of the invention generally designated by reference numeral 10. The adjustable hanger apparatus 10 is provided for hanging an object 12 on a vertical surface 14 and includes a first hanger assembly 16 for mounting on the vertical surface 14 and a second hanger assembly 18 for mounting on the object 12. The first hanger assembly 16 includes a first connector portion 22. The second hanger assembly 18 includes a longitudinal axis 20 and includes a plurality of second connection portions 24 arrayed along the longitudinal axis 20. The second connection portions 24 are adapted to connect to the first connector portion 22 of the first hanger assembly 16, such that, when a selected second connection portion 24 is connected to the first connector portion 22, the object 12 hangs by the second hanger assembly 18 and the first hanger assembly 16 next to the vertical surface 14.

The first hanger assembly 16 has a first width 26; the second hanger assembly 18 has a second width 28; and the first width 26 is greater than the second width 28. With the first width 26 being greater than the second width 28, the second hanger assembly 18 can be moved horizontally with respect to the first hanger assembly 16, whereby the object 12 attached to the second hanger assembly 18 can be positioned horizontally along the first hanger assembly 16 that is connected to the vertical surface 14.

The first hanger assembly 16 includes a pair of fastener-receiving portions 30 located at opposite ends of the first hanger assembly 16. A first connector portion 22 is located between the fastener-receiving portions 30. Each of the fastener-receiving portions 30 includes a rear wall 70 and a channel 52 for receiving a fastener such as a nail 50. The rear wall 70 and the channel 52 are oriented with respect to each other at a first predetermined acute angle 72. The first predetermined acute angle 72 is in a range spanning thirty to sixty degrees. The first predetermined acute angle 72 may be approximately forty-five degrees.

The first connector portion 22 includes a tongue 34 that projects outward from the first hanger assembly 16. Each of the second connection portions 24 of the second hanger assembly 18 includes a ridge portion 36 and a groove portion 38. The first hanger assembly 16 includes a well portion 32 located adjacent to the first connector portion 22. The well portion 32 is adapted to receive the ridge portion 36 of a selected second connection portion 24. The fastener-receiving portions 30 of the first hanger assembly 16 serve as barriers which prevent the ridge portion 36 of the selected second connection portion 24 from sliding off out of the well portion 32.

The well portion 32 includes a first inner wall 80 and a second inner wall 82 which are oriented with respect to each other at a second predetermined acute angle 84. The ridge portion 36 includes a front wall 86 and a rear wall 88, and the front wall 86 and the rear wall 88 of the ridge portion 36 are oriented with respect to each other at a third predetermined acute angle 90. The third predetermined acute angle 90 is less than or equal to the second predetermined acute angle 84, whereby the ridge portion 36 is capable of fitting into the well portion 32 with a tight fit.

In using the adjustable hanger apparatus 10 of the invention to hang the object 12, e.g. a picture, on the vertical surface 14, e.g. a wail, the first hanger assembly 16 is first attached to the vertical surface 14. Nails 50 are placed through channels 52 in the fastener-receiving portions 30 of the first hanger assembly 16 and are driven into the vertical surface 14. Alternately, screws can be used in place of the nails 50. The second hanger assembly 18 is attached to the back of the object 12 by using a screw 54 that is passed through a fastener-receiving channel 56 in the second hanger assembly 18.

The fastener-receiving channel 56 in the second hanger assembly 18 includes a first portion 58 which has a first width 60 and a second portion 62 which has a second width 64. The first width 60 is greater than the second width 64. Moreover the screw 54 is selected so that the diameter of the head of the screw 54 is less than the first width 60 and greater than the second width 64. In this way, the head of the screw 54 can be pressed up against a ledge 66 and press the second hanger assembly 18 against the object 12 when the screw 54 is screwed into the object 12.

With the second hanger assembly 18 attached to the vertical surface 14 and with the first hanger assembly 16 attached to the vertical surface 14, a person grasps the object 12 and places a selected groove portion 38 of the second hanger assembly 18 over the tongue 34 of the first hanger assembly 16. Then, the person releases the object 12 permitting gravity to pull the groove portion 38 over the tongue 34, whereby the object 12 hangs on the vertical surface 14. At the same time the tongue 34 enters the groove portion 38, the ridge portion 36 of the second hanger assembly 18 enters the well portion 32 of the first hanger assembly 16, whereby the connection between the second hanger assembly 18 and the first hanger assembly 16 is stabilized.

Vertical adjustment of the object 12 on the vertical surface 14 is obtained by appropriate selection of a specific groove portion 38 and ridge portion 36 of the second hanger assembly 18 along the longitudinal axis 20 to be placed in registration with the tongue 34 and the well portion 32 of the first hanger assembly 16, respectively. With the ridge portion 36 of the second hanger assembly 18 in the well portion 32 of the first hanger assembly 16, the second hanger assembly 18 can be moved horizontally along the well portion 32 to provide a horizontal adjustment of the object 12 on the vertical surface 14. The fastener-receiving portions 30 of the first hanger assembly 16 have inside walls 78 which serve as stops or limits to horizontal movement of the ridge portion 36 in the well portion 32.

Figure 5:
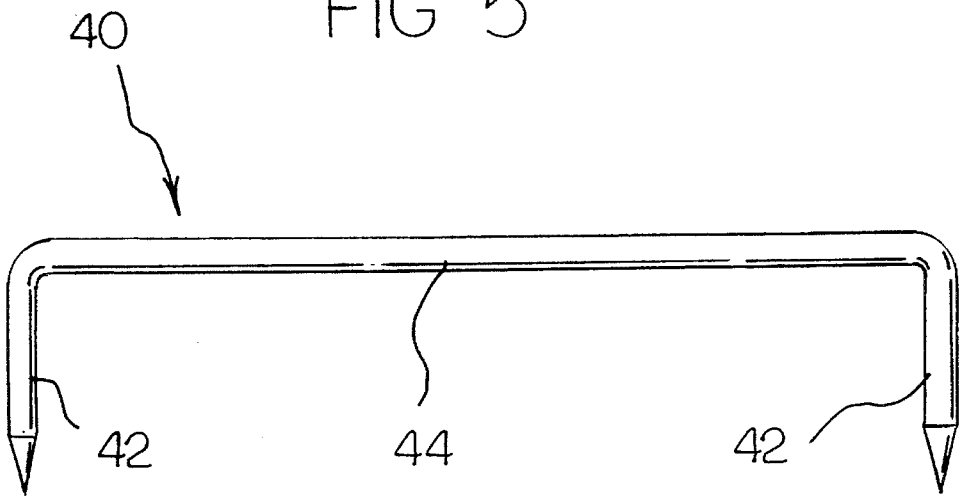
FIG. 5 is a front view of a second embodiment of a wall-mounted portion of the invention.
Figure 6:
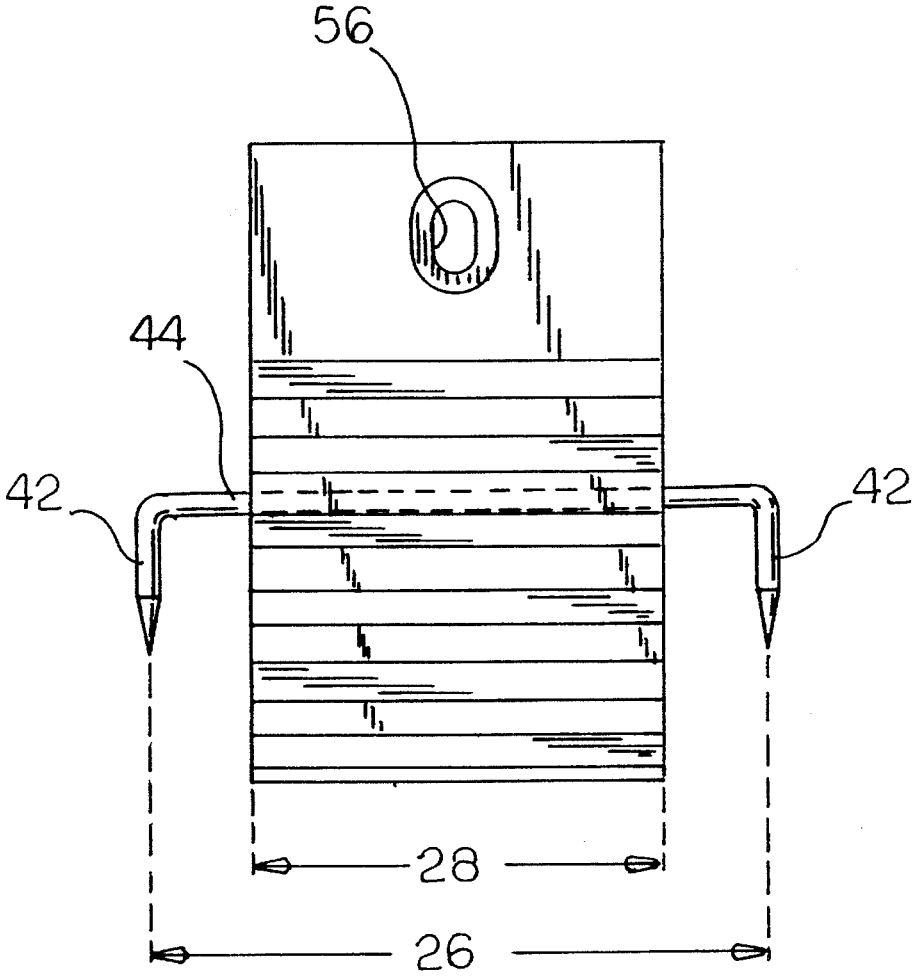
FIG. 6 is a front view of the embodiment of the wall-mounted portion of the invention shown in FIG. 5 placed upon a picture-mounted portion of the invention which is shown in FIGS. 1 and 4.
Figure 7:
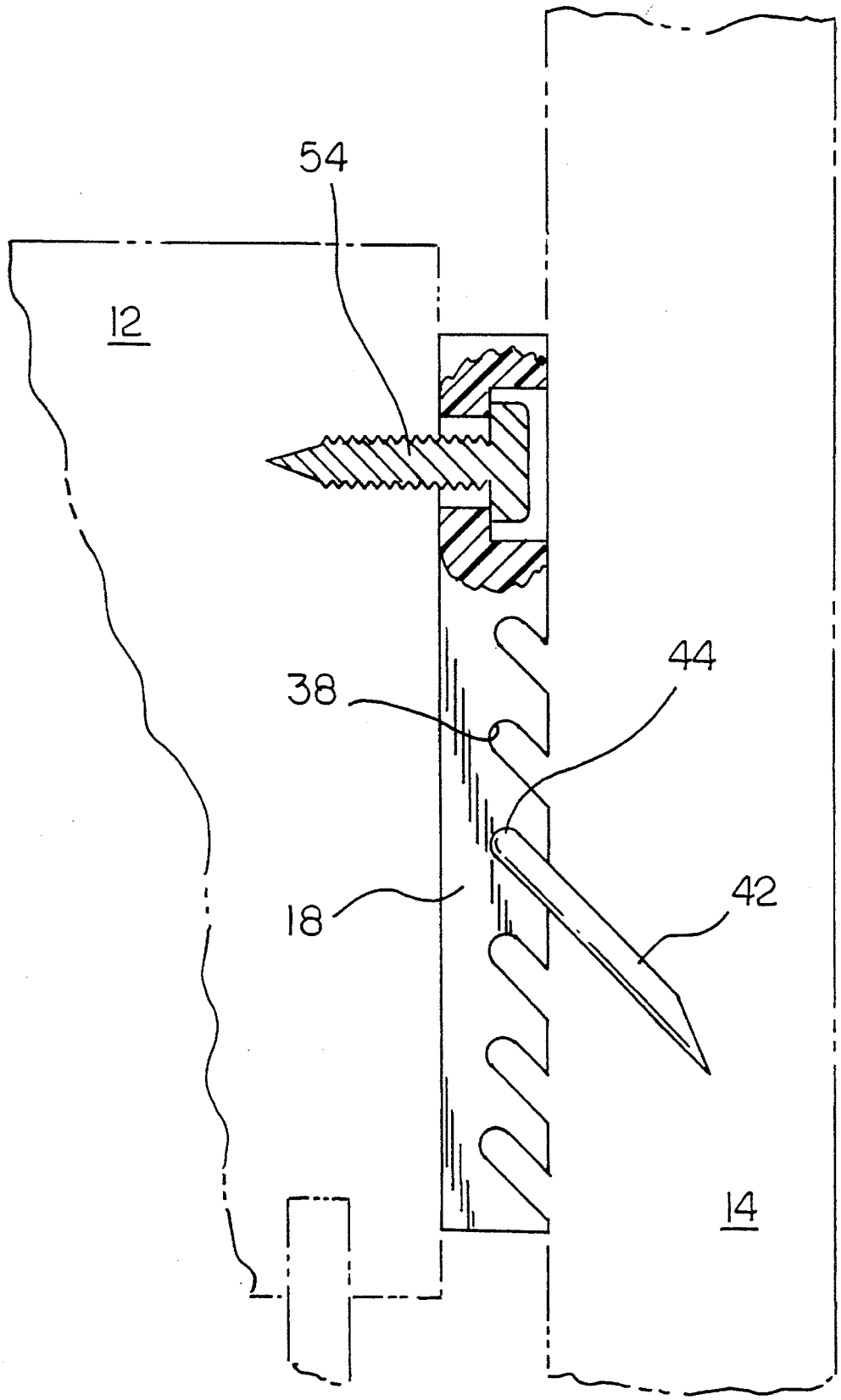
FIG. 7 is a side view, partially broken away, of the embodiment of the wall-mounted portion of the invention shown in FIGS. 5 and 6 supporting a picture employing the picture-mounted portion of the invention shown in FIG. 6.

Turning to FIGS. 5–7, a second embodiment of the invention is shown. Reference numerals are shown that correspond to like reference numerals that designate like elements shown in the other figures. In addition, the first hanger assembly 16 includes a double-nail assembly 40 adapted to be driven in the vertical surface 14. The double-nail assembly 40 includes a pair of nail portions 42, and a transverse bar portion 44 is connected between the nail portions 42. The transverse bar portion 44 serves as the first connector portion 22 of the first hanger assembly 16 for connecting to the second connection portion 24 of the second hanger assembly 18.

More specifically, the transverse bar portion 44 of the double-nail assembly 40 readily fits into a selected groove portion 38 of the second hanger assembly 18, whereby the object 12 is supported on the vertical surface 14 by way of the nail portions 42 driven into the vertical surface 14, the transverse bar portion 44 supported by the double-nail assembly 40 and projecting outward from the vertical surface 14, the selected groove portion 38 of the second hanger assembly 18 which receives the transverse bar portion 44, the body of the second hanger assembly 18, and a screw 48 which secures the second hanger assembly 18 to the object 12.

The components of the adjustable hanger apparatus of the invention can be made from inexpensive and durable metal or plastic materials, plastic materials being preferred.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved adjustable hanger apparatus that is low in cost, relatively simple in design and operation, and which may advantageously be used without employing a flexible cord or wire for hanging a picture on a wall. With the invention, an adjustable hanger apparatus is provided which does not require a process of trial and error resulting in a number of improperly vertically located holes in a wall. With the invention, an adjustable hanger apparatus is provided which does not require a process of trial and error resulting in a number of improperly horizontally located holes in a wall. With the invention, an adjustable hanger apparatus is provided which is not severely restricted in the kinds of materials that can be employed in fabricating the hanger apparatus. With the invention, an adjustable hanger apparatus is provided which does not require readjusting support nails vertically or horizontally in order to readjust the vertical and horizontal position of a picture supported by the support nails.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. An adjustable hanger apparatus for hanging an object on a vertical surface, comprising:

a first hanger assembly for mounting on the vertical surface, said first hanger assembly including a first connector portion, and a second hanger assembly for mounting on the object, wherein said second hanger assembly includes a longitudinal axis, wherein said second hanger assembly includes a plurality of second connection portions arrayed along said longitudinal axis, and wherein said second connection portions are adapted to connect to said first connector portion of said first hanger assembly, such that, when a selected second connection portion is connected to said first connector portion, the object hangs by said second hanger assembly and said first hanger assembly next to the vertical surface, wherein said first hanger assembly includes:

a pair of fastener-receiving portions located at opposite ends of said first hanger assembly, and said first connector portion being located between said fastener-receiving portions, wherein each of said fastener-receiving portions includes a rear wall and a channel for receiving a fastener, wherein said rear wall and said channel are oriented with respect to each other at a first predetermined acute angle.

2. The apparatus of claim 1 wherein:

said first hanger assembly has a first width, said second hanger assembly has a second width, and said first width is greater than said second width.

3. The apparatus of claim 1 wherein said first predetermined acute angle is in a range spanning thirty to sixty degrees.

4. The apparatus of claim 3 wherein said first predetermined acute angle is approximately forty-five degrees.

5. The apparatus of claim 1 wherein said first connector portion includes a tongue that projects outward from said first hanger assembly.

6. The apparatus of claim 1 wherein each of said second connection portions of said second hanger assembly includes a ridge portion and a groove portion.

7. The apparatus of claim 6 wherein said first hanger assembly includes a well portion located adjacent to said first connector portion, wherein said well portion is adapted to receive said ridge portion of a selected second connection portion.

8. The apparatus of claim 7 wherein:

said well portion includes a first inner wall and a second inner wall, said first inner wall and said second inner wall of said well portion are oriented with respect to each other at a second predetermined acute angle, said ridge portion includes a front wall and a rear wall, and said front wall and said rear wall of said ridge portion are oriented with respect to each other at a third predetermined acute angle, wherein said a third predetermined acute angle is less than or equal to said second predetermined acute angle, whereby said ridge portion is capable of fitting into said well portion with a tight fit.

9. The apparatus of claim 1 wherein said first hanger assembly includes a double-nail assembly adapted to be driven in the vertical surface.

10. The apparatus of claim 9 wherein said double-nail assembly includes:

a pair of nail portions, and a transverse bar portion connected between said nail portions, wherein said transverse bar portion serves as said first connector portion of said first hanger assembly for connecting to said second connection portion of said second hanger assembly.

11. An adjustable hanger apparatus for hanging an object on a vertical surface, comprising:

a first hanger assembly for mounting on the vertical surface, said first hanger assembly including a first connector portion, and a second hanger assembly for mounting on the object, wherein said second hanger assembly includes a longitudinal axis, wherein said second hanger assembly includes a plurality of second connection portions arrayed along said longitudinal axis, and wherein said second connection portions are adapted to connect to said first connector portion of said first hanger assembly, such that, when a selected second connection portion is connected to said first connector portion, the object hangs by said second hanger assembly and said first hanger assembly next to the vertical surface, wherein each of said second connection portions of said second hanger assembly includes a ridge portion and a groove portion, wherein said first hanger assembly includes a well portion located adjacent to said first connector portion, wherein said well portion is adapted to receive said ridge portion of a selected second connection portion, and wherein said well portion includes a first inner wall and a second inner wall, said first inner wall and said second inner wall of said well portion are oriented with respect to each other at a second predetermined acute angle, said ridge portion includes a front wall and a rear wall, and said front wall and said rear wall of said ridge portion are oriented with respect to each other at a third predetermined acute angle, wherein said third predetermined acute angle is less than or equal to said second predetermined acute angle, whereby said ridge portion is capable of fitting into said well portion with a tight fit.

12. An adjustable hanger apparatus for hanging an object on a vertical surface, comprising:

a first hanger assembly for mounting on the vertical surface, said first hanger assembly including a first connector portion, and a second hanger assembly for mounting on the object, wherein said second hanger assembly includes a longitudinal axis, wherein said second hanger assembly includes a plurality of second connection portions arrayed along said longitudinal axis, and wherein said second connection portions are adapted to connect to said first connector portion of said first hanger assembly, such that, when a selected second connection portion is connected to said first connector portion, the object hangs by said second hanger assembly and said first hanger assembly next to the vertical surface, wherein said first hanger assembly includes a double-nail assembly adapted to be driven in the vertical surface, and wherein said double-nail assembly includes:

a pair of nail portions, and a transverse bar portion connected between said nail portions, wherein said transverse bar portion serves as said first connector portion of said first hanger assembly for connecting to said second connection portion of said second hanger assembly.

* * * * *